US006843030B2

(12) United States Patent
Zingerman

(10) Patent No.: US 6,843,030 B2
(45) Date of Patent: Jan. 18, 2005

(54) SELF-LIFTING VERTICALLY RISING MAST

(76) Inventor: David Zingerman, 1714 N. Ivar Ave., Apt. #803, Los Angeles, CA (US) 90028

( * ) Notice: Subject to any disclaimer, the term of this patent is extended or adjusted under 35 U.S.C. 154(b) by 59 days.

(21) Appl. No.: 10/436,520

(22) Filed: May 13, 2003

(65) Prior Publication Data

US 2004/0226258 A1 Nov. 18, 2004

(51) Int. Cl.[7] ..... B66C 23/34
(52) U.S. Cl. ..... 52/123.1; 52/121; 52/745.17
(58) Field of Search ..... 52/123.1, 121, 52/122.1, 745.17, 111, 114, 651.07; 343/874, 875

(56) References Cited

U.S. PATENT DOCUMENTS 2,794,242 A * 6/1957 Evers et al. ..... 29/429
3,673,754 A * 7/1972 Murashige et al. ..... 52/745.17
3,945,107 A 3/1976 Houck
5,794,387 A 8/1998 Crookham

* cited by examiner

*Primary Examiner*—Naoko Slack

(57) ABSTRACT

A self-lifting vertically rising mast provides a possibility to be erected without use of high cranes. An improved self-lifting vertically rising mast includes at least three of a plurality of main frames and at least three of a plurality of main supports, wherein each main frame is rigidly connected to the appropriate main support and comprises the base, U-form directors, lifting shoe inserted into the U-slots of the U-form directors, the hydraulic jack installed on the base of the main frame, pusher including the rests, hollow upright leant on the sleeve of the bush, comprising the pivotable portion having the slots providing passage for the rests, the pair of the guiding shoes longitudinally movable along the auxiliary directors, the holder located between the auxiliary directors and fixing the appropriate upright in the vertical position, and the controllable supports, comprising the stand, the extendable screw, and the nut, which fixes the desirable position (extension) of the extendable screw.

2 Claims, 2 Drawing Sheets

36-36

37-37

SELF-LIFTING VERTICALLY RISING MAST

FIELD OF THE INVENTION

This invention is generally related to the arts of high structural supporting constructions, such as masts, poles, columns and piers, and more particularly to the mast which can be assembled in a vertical position, section by section erected by built-in self-lifting apparatus.

BACKGROUND OF THE INVENTION

In the prior art there are many types of structural masts, poles requiring the assembling on a level ground and then tilted into vertical position by lifting the top end of the mast by crane. Such type of masts and poles assembly requires a very long clear working area that is substantially horizontal and free of any obstacles such as constructions, trees and vegetation.

Such commonly known in the art construction technology is expensive and not efficient.

Another method and device to lift a pole is described in U.S. Pat. No. 5,794,387 generally includes the pole and bases, lower frame which extends along the ground. Lower frame comprises elongated beams and cross beams. Also, the device includes the collar connected to the left ends of beams, two elongated side rails that are positioned to straddle opposite sides of pole and base, cross braces holding the rails in spaced apart parallel position but are U-shaped to allow pole to be centered between rails, the auxiliary tower pivotably attached by pivots to lower frame, the hydraulic cylinders (jacks) facilitating the tilting action of the auxiliary tower with the inserted pole, and more components providing the griping and lifting operation for pole erection.

This device is complex and does not provide the erection of the massive, high (over 30–100 feet) poles, columns and/or masts.

Some types of structural masts can be erected in more convenient method: to transport the tower by sections or partial sections by means of helicopters into a cleared area only sufficiently large to assemble the mast in a vertical position. This method to rise the masts (e.g. TV-masts), poles, columns and piers requires the use of cranes with the boom that is longer than the total height of the mast.

The use of the crane increases the construction expenses and requires more space under construction.

The process of erecting vertical rising mast disclosed in U.S. Pat. No. 3,945,107 describes a system which is intended for section by section assembling in a vertical position, as distinguished from the conventional method of raising a mast by assembling the mast in a horizontal position on the ground and then lifting the mast into a vertical position. The mast is made of a base section and a plurality of upper sections, each one adapted to be mounted on top of the one below it and fastened thereto. After the base section has been assembled on the foundation, the succeeding sections are assembled on the ground or are lifted in pieces and assembled in place on top of the previous section by means of a floating gin pole. The gin pole is supported inside of the mast by means of a plurality of basket cables, which are attached at one end to the bottom of the gin pole and attached at their other ends to a corresponding plurality of points on the top of the last previously positioned section. The floating gin pole extends above the top of the topmost assembled section, and can tilt to the outside of the mast, so as to lift section parts outside the mast. When the bottom end of the gin pole is supported in this way, luffing lines can be attached to the top end of the gin pole, and attached to small winches which are fastened to the top of the last previously positioned section, as the mast is being erected. Since the gin pole extends well above previously assembled section, it extends far enough to the side of the mast to pick up parts of the upper sections, which can be lifted into position on top of the previously assembled section and fastened to it. As each section is added to the mast, the gin pole is lifted by one section, the basket lines being fastened to corresponding points on the section above.

Also the system includes a plurality of jump lines which are attached to the newly added section near its top, by means of which the base end of the floating gin pole can be lifted so that the basket lines can be moved to their corresponding positions on the newly added section. Then, after another new section is added, the base of the floating gin pole is again lifted and the basket lines moved up another section and so on. In this manner each of the sections in turn can be added to those already in place, until the mast is completely assembled. The remaining step is to remove the floating gin pole from the structure. The means for removing the gin pole is positioned on the top of the mast an auxiliary support and block means. This can be a conventional jib boom, by means of which the lifting cable and winch can be used to lift the gin pole, so that the basket cables can be removed and the gin pole can then be lowered to the ground down through the inside of the mast. The jib boom is then used to assemble the crown assembly and the crown block on top of the top section of the mast. After the top of the mast is completed a jib boom, or auxiliary support and block means, is mounted on the top section and used as a means to lower the floating gin pole to the ground. The auxiliary support means is then used to assemble the crown block on top of the mast. The jib boom is mounted on the top section and used as a means to lower the floating gin pole to the ground. The auxiliary support means is then used to assemble the crown block on top of the mast.

Such device is complex, requires basket cable system for built-in crane-like equipment.

Thus, there is a great need in the art for the improved self-lifting vertically rising mast, providing convenient, economical, effective and safe construction process and device for high masts, poles and columns erection.

OBJECT AND ADVANTAGES OF THE INVENTION

Accordingly, several objects and advantages of the present invention are to provide convenient, economical and effective self-lifting vertically rising mast, column.

It is another object of the invention to eliminate necessity of the use of high cranes.

It is still another object of the invention to eliminate construction labor (assembling, welding of the sections) on the height, thereby increasing the safety.

It is further object of the invention to provide less area under construction.

It is still further object of the invention to decrease time of the construction labor.

It is still another object of the invention to increase efficiency of the construction labor.

These and other objects and advantages of this invention and a better understanding of the principles and details of the invention will become apparent from a consideration of the ensuing description accompanying drawings.

DESCRIPTION OF THE DRAWING

In order that the invention and the manner in which it is to be performed may be more clearly understood, embodiments thereof will be described by way of example with reference to the attached drawings, of which.

SUMMARY OF THE INVENTION

In view of the foregoing disadvantages inherent in the known prior art, the present invention provides a new self-lifting vertically rising mast. As such, the general purpose of the present invention, which will be described hereinafter in greater details, is to provide a new convenient, economical and effective vertically rising mast or column with the lifting means. The improved self-lifting vertically rising mast has many of the advantages of the construction objects, such as masts, columns and poles and many novel features that result in the convenience and safety of construction labor, which are not anticipated, rendered obvious, suggested or even implied by any of prior art vertically rising masts. For example, the self-lifting vertically rising mast can be built-up in the difficult accessible for construction work areas.

To attain this, the present invention generally includes at least three of a plurality of main frames and at least three of a plurality of main supports, wherein the main frames are rigidly connected to the appropriate main supports. Each main frame comprises a base rigidly connected to the side plates, which includes the U-form directors. Also, each main frame comprises the lifting shoe inserted into the U-slots of the U-form directors, the hydraulic jack installed on the base of the main frame. The rod of the hydraulic jack is coupled with the lower surface of the lifting shoe, the upper surface of which includes a hemispherical cavity, wherein is installed pusher coupled with the lifting shoe by the bracket. Each pusher includes the rests rigidly connected to the pusher, and the longitudinal distance between rests is equal to the length of the fully extended rod of the hydraulic jack, that is equivalent to each single lifting step. The improved device also includes hollow uprights, each of which is leant on the sleeve of the bush, comprising the pivotable portion having the slots providing passage for the rests, the pair of the guiding shoes longitudinally movable along the auxiliary directors, the holder located between the appropriate auxiliary directors and fixing the appropriate upright in the vertical position, and the controllable supports, comprising the stand, the extendable screw, and the nut, which fixes the desirable position (extension) of the extendable screw.

DESCRIPTION OF THE PREFERRED EMBODIMENTS

Here the description of an improved self-lifting vertically rising mast will be done in statics (as if the components of the improved apparatus are suspended in the space) with description of their relative connections to each other. The description of the functional operations will be done hereinafter.

Figure 1:
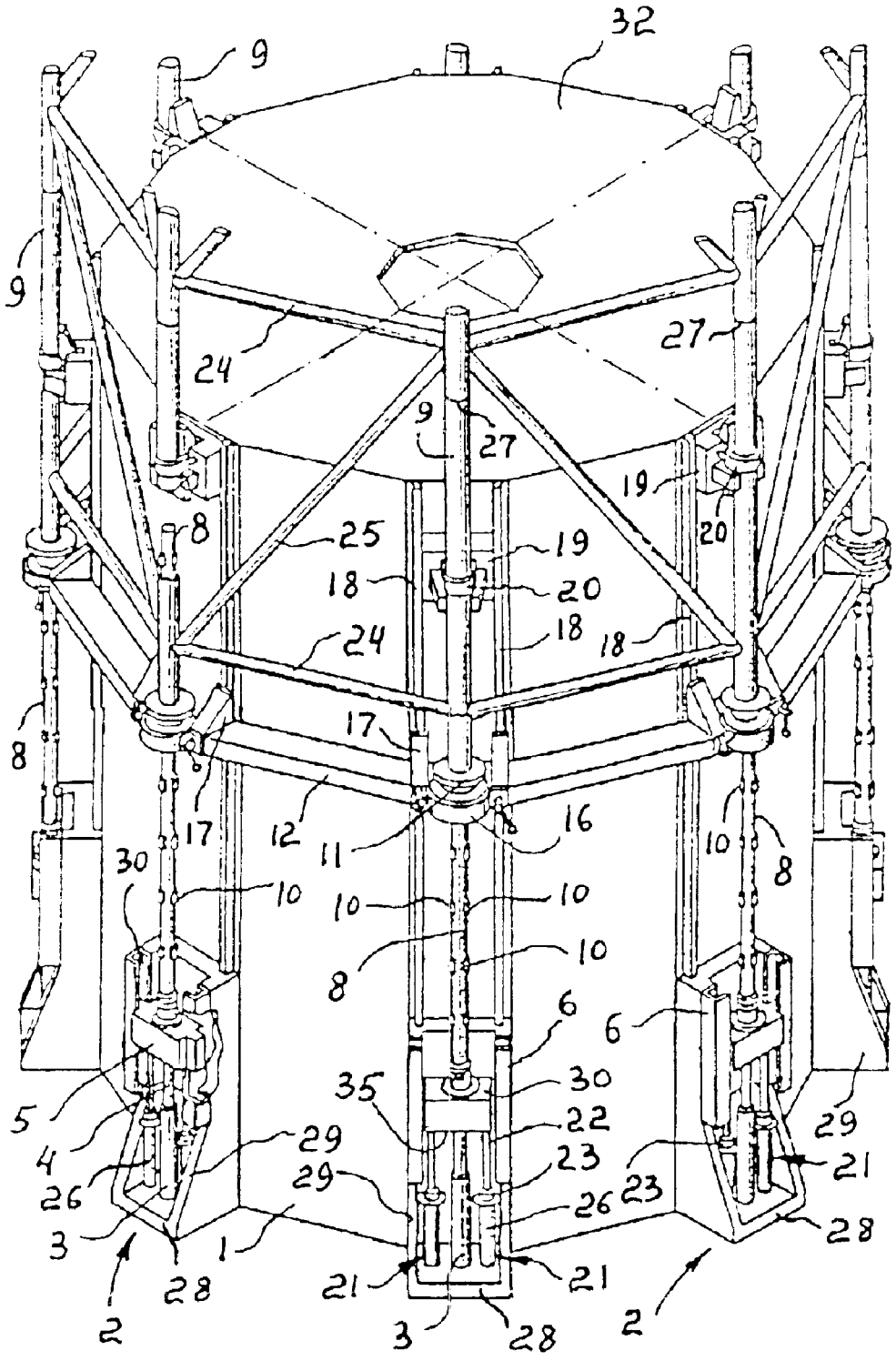
FIG. 1 is a simplified spatial view of an improved self-lifting vertically rising mast.
Figure 2:
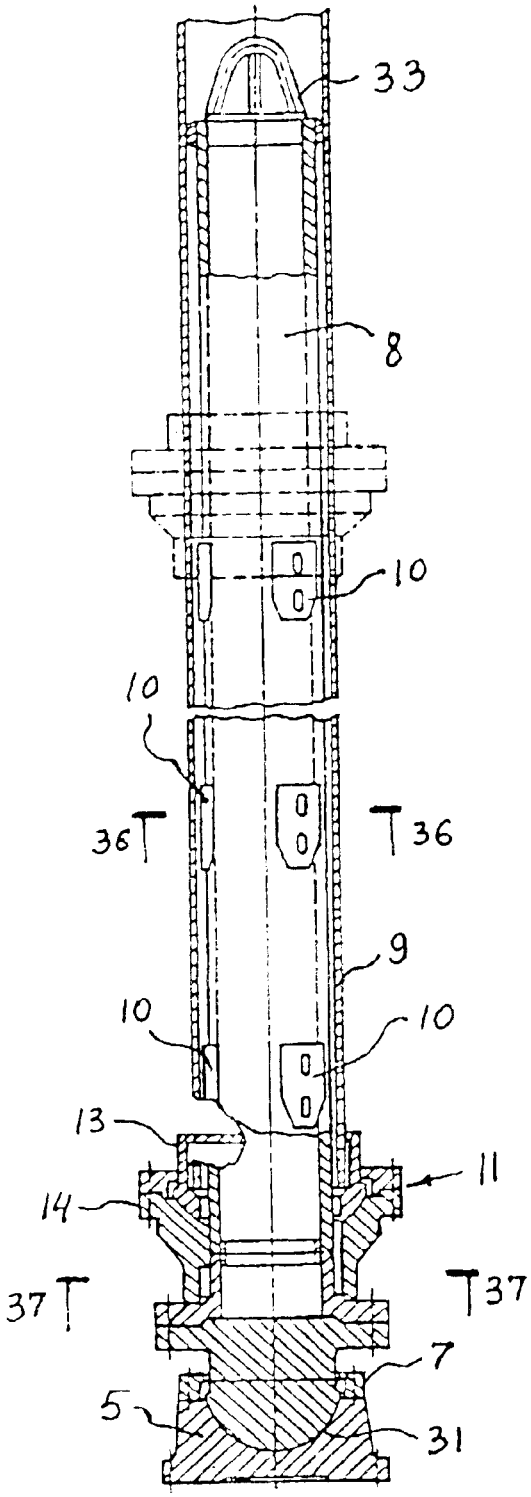
FIG. 2 is a simplified drawing of the lifting mechanism portion.
Figure 3:
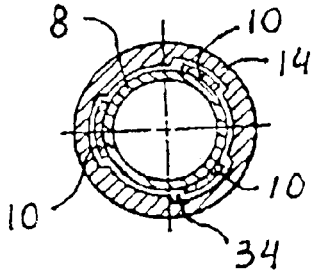
FIG. 3 is a simplified drawing of a cross-sectional view 36—36.
Figure 4:
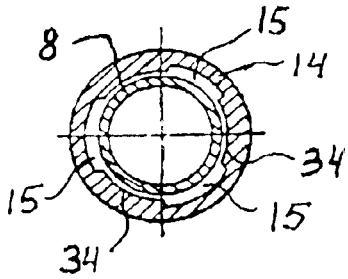
FIG. 4 is a simplified drawing of a cross-sectional view 37—37.

An improved self-lifting vertically rising mast includes at least three of a plurality of main frames 2 and at least three of a plurality of main supports 1. On FIG. 1 is conditionally shown the mast including eight main frames 2 and eight main supports 1. The main frames 2 of the lifting mechanism are rigidly connected to the appropriate main supports 1. Each main frame 2 comprises a base 28 rigidly connected to the side plates 29 (left side plate and right side plate). Each side plate 29 of the main frame 2 includes the U-form director 6. The lifting shoe 5 of each main frame 2 is inserted into the U-slots 30 of the U-form directors 6. The directors 6 are rigidly connected to the appropriate auxiliary directors 18. All directors (the U-form directors 6 and auxiliary directors 18) are rigidly connected to the adjacent main supports 1. Each main frame 2 also includes the hydraulic jack 3 installed on the base 28 of the main frame 2, and the top of the rod 4 of the hydraulic jack 3 is coupled with the lower surface 35 of the lifting shoe 5. The upper surface 30 of the lifting shoe 5 includes a hemispherical cavity 31. The upper sides of the main supports 1 and upper sides of the main frames 2 are rigidly connected to the cross-sectional support 32, forming the rigid construction of the lifting portion of the mast. The lifting mechanism also includes the pushers 8, each of which is installed in the appropriate hemispherical cavity 31 of each lifting shoe 5, as shown on FIG. 2, and coupled with the lifting shoe 5 by the bracket 7. The pusher 8 has the solid configuration. The uprights 9 are put on the pushers 8 (the outside cross-sectional dimensions of the pusher 8 is smaller than the inside cross-sectional dimensions of the upright 9). The upright 9 has a hollow configuration of any geometric form adequate to the geometric configuration of the pusher 8, e.g. if the pusher 8 is of square form, the upright 9 has to be of tubular square form or if the pusher 8 is of cylindrical form, the upright 9 has to be of tubular cylindrical form (on FIGS. 1–3 are conditionally shown the cylindrical pushers 8 and tubular uprights 9). Each pusher 8 includes the rests 10 rigidly connected (for example welded) to the pusher 8. The longitudinal distance between rests 10 is equal to the length of the fully extended rod 4 of the hydraulic jack 3, that is equivalent to each single lifting step. The cross-sectional view of the pusher 8 with the rests 10 is shown on FIG. 3. The length of the pusher 8 is preferably adequate to the length of the upright 9. Each upright 9 is leant on the sleeve 13 of the bush 11, as shown on FIG. 2. The bush 11 also comprises the pivotable portion 14 having the slots 15 providing passage for the rests 10 (see FIGS. 3, 4). Each bush 11 is by a main cramp 16 coupled with the pair of the guiding shoes 17 longitudinally movable along the auxiliary directors 18. Each pair of the guiding shoes 17 are rigidly connected to the mast's cross-sectional frame 12. Each holder 19 is located between the appropriate auxiliary directors 18, and fixes the appropriate upright 9 in the vertical position. The upright 9 is coupled with the holder 19 by the auxiliary cramp 20.

Each main frame 2 also includes the controllable support (s) 21, comprising h stand 26, the extendable screw 22, and the nut 23. The rotatable nut 23 fixes the desirable position (extension) of the extendable screw 22.

The process of the improved self-lifting vertically rising mast installation includes the steps as follows below. Initially, all lifting shoes 5 are at the lower position. Each pusher 8, resting on the hemispherical cavity 31 of the lifting shoe 5, one by one in sequence is declined from its initial vertical position (for convenience, the cap 33 rigidly connected to the pusher 8 can be used/see FIG. 2/), the bush 11 and the hollow upright 9 are appropriately put on the declined pusher 8, and the upright 9 (with the pusher 8 inside) is installed (returned) in the vertical position. After that, the upright 9 is coupled with the holder 19 by the auxiliary cramp 20. All uprights 9 of the mast are rigidly coupled (for example, welded) to each other by girders 24 and struts 25, thereby forming the first section of the mast. The girders 24 and struts 25 can be of any material assigned for the mast, e.g. 1-girders, tubes, etc.

On the next step, all pivotable portion 14 of all bushes 11 are installed in the positions where the rests 10 of each appropriate pusher 8 are located under the ledges 34 of the pivotable portion 14 of the bush 11, as shown on FIG. 3. All hydraulic jacks 3 are simultaneously turned-on and the rods 4 lift the lifting shoes 5, thereby lifting the assembled first section of the mast on the first step of the elevation. The screws 22 are extended from the stand 26 to the position when the top of each screw 22 is slightly not in the contact with the lower surface 35 of the appropriate lifting shoe 5, and the nut 23 of each of the controllable support 21 are tightened, thereby providing fixation of the screw 22 position. The hydraulic jacks 3 are slowly released, and the first mast section is leant (rests) on the extended controllable supports 21 (at this position the lower surface 35 of each lifting shoe 5 is rested on the top of the appropriate screw 22 of controllable support 21).

On the next step of the first section elevation, one by one in sequence the pivotable portion 14 of each bush 11 is rotated in the position where the rests 10 of the pusher 8 are located under appropriate slots 15 of the pivotable portion 14 of the nuts 11 (during the operation with the selected pusher of the selected main frame 2, the pivotable portions 14 of all other bushes 11 are still in the position where the rests 10 of the pushers 8 are located under ledges 34 of pivotable portion 14 of the nuts 11, thereby providing support of the of the mast's section on the already elevated level). After that, the rod 4 of the hydraulic jack 3 is extended in the position when the upper side of the rod 4 is contacted with the lower surface 35 of the lifting shoe 5, the nut 23 is loosen, the screws 22 are installed in the initial non-extended position, and the hydraulic jack 3 is slowly released to the initial non-extended position, thereby bringing the pusher 8 down at the initial position. Then the pivotable portion 14 of the bush 11 is rotated again in the position when the rests 10 of the pusher 8 are located under appropriate ledge 34 of the pivotable portion 14 of the nut 11, and the rod 4 is slightly extended until contact of the rests 10 with the ledges 34. The work with the selected main frame 2 is completed and operator provides the same operation with the another main frame in sequence one by one.

After all main frames 2 are ready for the second step, all hydraulic jacks 3 are turned-on, the rods 4 are extended in their highest positions and the lifting cycle operations are analogously repeated until the mast's section will be elevated on the desired level.

For the next cycle, for example, second section assembling and elevation each pusher 8, resting on the hemispherical cavity 31 of the lifting shoe 5, one by one in sequence is declined and the next hollow uprights 9 are appropriately put on the declined pusher 8. Each upright 9 (with the appropriate pusher 8 inside) is installed back in the vertical position and the upper side of the second upright 9 is rigidly connected with the lower side of the first upright 9, for example by welding (on FIG. 1 the welded edges are marked by 27). After that, each upright 9 is coupled with the holder 19 by the auxiliary cramp 20. All uprights 9 of the mast are rigidly coupled (for example, welded) to each other by girders 24 and struts 25 thereby forming the next (e.g. second) section of the mast. On the next step, all pivotable portion 14 of all bushes 11 are installed (rotated) in the positions where the rests 10 of the appropriate pushers 8 are located under the ledge 34 of the pivotable portion 14 of the bush 11 and lifting steps are repeated as above described.

The bushes 11 can be used the same for all lifting cycles (can be reinstalled on the pushers 8 for each cycle) or for each cycle can be used the new bushes 11. The holders 19 and auxiliary cramps 20 are used the same for all lifting cycles.

Thus, an improved self-lifting vertically rising mast provides convenient, economical, effective and safe process and device for high masts, poles, and columns erection.

CONCLUSION, RAMIFICATION AND SCOPE

Accordingly the reader will see that, according to the invention, I have provided a self-lifting vertically rising mast, providing convenient, economical, effective and safe process and device for high masts, poles, and columns construction.

An improved self-lifting vertically rising mast has various possibilities, considering the specific features of the construction work.

While the above description contains many specificities, these should be not construed as limitations on the scope of the invention, but as exemplification of the presently-preferred embodiments thereof. Many other ramifications are possible within the teaching to the invention. For example, an improved self-lifting vertically rising mast can be successfully used in the difficult accessible areas for erection of the power electrical line masts, oil drilling masts, TV and radio retransmission masts, etc.

Thus, the scope of the invention should be determined by the appended claims and their legal equivalents, and not be examples given.

The Drawing Reference Numerals Worksheet

1.—a main support;
2.—a main frame;
3.—a hydraulic jack;
4.—a rod (of the hydraulic jack 3);
5.—a lifting shoe;
6.—a director;
7.—a bracket;
8.—a pusher;
9.—an upright;
10.—a rest;
11.—a bush;
12.—a cross-sectional frame;
13.—a sleeve,
14.—a pivotable portion (of bush 11);
15.—a slot;
16.—a main cramp;
17.—a guiding shoe;
18.—an auxiliary director;
19.—a holder;
20.—an auxiliary cramp;
21.—a controllable support;
22.—a screw (of controllable support 21);
23.—a nut (of controllable support 21);
24—a girder;
25.—a strut;
26.—a stand (of controllable support 21);
27.—a welded edges (of the uprights 9);
28.—a base;
29.—a side plate;
30.—an upper surface of the lifting shoe 5;

31.—a hemispherical cavity;
32.—cross-sectional support;
33.—a cap;
34.—a ledge;
35.—a lower surface (of the lifting shoe);
36—36 is a cross sectional view;
37—37 is a cross-sectional view.

What is claimed is:

1. A self-lifting vertically rising mast including at least three of a plurality of main frames rigidly connected to each other by main supports, and wherein each of said main frame comprises a base rigidly connected to a left side plate and a right side plate, each of which includes an U-form director comprising an U-slot, and wherein each of the U-form directors is rigidly connected to an appropriate auxiliary director;

a lifting shoe inserted into said U-slots of said U-form directors, and wherein an upper surface of said lifting shoe includes a hemispherical cavity;

a hydraulic jack 3 installed on said base of said main frame, and wherein an extendable rod of said hydraulic jack is coupled with a lower surface of said lifting shoe;

at least two of a plurality of controllable supports, each of which comprises a stand, an extendable screw and a nut fixing the extended position of said extendable screw;

a pusher installed in said hemispherical cavity and coupled with said lifting shoe by a bracket and with a sleeve, and wherein said pusher includes at least two of a plurality of rests rigidly connected to said pusher;

a hollow upright installed in said sleeve, and wherein inside of said hollow upright is inserted said pusher;

a bush comprising a pivotable portion including at least two of a plurality of slots, providing a passage for said rests, and at least two of a plurality of ledges, and wherein said bush is coupled with said pusher;

a holder installed between the auxiliary directors to provide a fixation of said upright in the vertical position, and wherein said holder is coupled with said upright by an auxiliary cramp.

2. The device of claim 1, wherein the longitudinal distance between said rests is adequate to the length of the fully extended rod of said hydraulic jack.

* * * * *